US009376184B2

(12) United States Patent
Taylor

(10) Patent No.: US 9,376,184 B2
(45) Date of Patent: Jun. 28, 2016

(54) METHOD AND SYSTEM FOR PROVIDING GROUND MOBILITY FOR A DOCK

(71) Applicant: Techstar Plastics Inc., Port Perry (CA)

(72) Inventor: William Garth Taylor, Port Perry (CA)

(73) Assignee: Techstar Plastics Inc., Port Perry (CA)

( * ) Notice: Subject to any disclaimer, the term of this patent is extended or adjusted under 35 U.S.C. 154(b) by 135 days.

(21) Appl. No.: 13/627,568

(22) Filed: Sep. 26, 2012

(65) Prior Publication Data

US 2014/0083347 A1 Mar. 27, 2014

(51) Int. Cl.

| | |
|---|---|
| ***B63C 13/00*** | (2006.01) |
| ***B63B 35/38*** | (2006.01) |
| *E02B 3/06* | (2006.01) |

(52) U.S. Cl.

CPC ..... *B63C 13/00* (2013.01); *B63B 35/38* (2013.01); *E02B 3/064* (2013.01)

(58) Field of Classification Search

CPC ..... B63B 3/08; E02B 3/064; B63C 1/02; B63C 3/01; B63C 13/00

USPC ..... 114/263, 344; 280/414.1, 414.2, 414.3, 280/414.5; 405/219–221

See application file for complete search history.

(56) References Cited

U.S. PATENT DOCUMENTS

| | | | | |
|---|---|---|---|---|
| 2,992,444 | A * | 7/1961 | Schuler | B63B 35/732 114/344 |
| 4,037,420 | A * | 7/1977 | Wicks | E02B 3/068 405/218 |
| 4,434,992 | A * | 3/1984 | Beach-Thomas | B63C 13/00 114/344 |
| 4,480,578 | A * | 11/1984 | Fisher | B63C 13/00 114/344 |
| 5,493,992 | A * | 2/1996 | Johnson | 114/263 |
| 6,098,564 | A * | 8/2000 | Zeilinger | B63B 35/34 114/263 |
| 7,147,240 | B2 * | 12/2006 | Naito | B60F 3/0061 114/344 |
| 7,216,602 | B2 * | 5/2007 | Towley, III | B63C 13/00 114/344 |
| 2009/0084303 | A1 * | 4/2009 | Kazmierowicz | 114/344 |
| 2015/0114276 | A1 * | 4/2015 | Ramey | B63B 21/16 114/230.22 |

* cited by examiner

*Primary Examiner* — Andrew Polay
(74) *Attorney, Agent, or Firm* — McMillan LLP

(57) ABSTRACT

A method and system for providing ground mobility for a dock is provided. The system includes at least one wheel assembly. Each wheel assembly includes a base element configured to be secured to a bottom portion of a dock, and at least one wheel rotatably coupled to the base element. Each wheel assembly is configured such that when the base element is secured to the bottom portion of the dock, the dock is at least partially supported by and rolls along ground on the wheels. The at least one wheel assembly is buoyant in water.

4 Claims, 5 Drawing Sheets

METHOD AND SYSTEM FOR PROVIDING GROUND MOBILITY FOR A DOCK

FIELD OF THE INVENTION

The present invention relates generally to transportation. In particular, the invention relates to a method and system for providing ground mobility for a dock.

BACKGROUND OF THE INVENTION

Floating docks are known. Many such docks are can be divided into one or more articulated segments held together via some type of linkage. The floating dock portions can be entirely wood structures, or, alternatively, can be assembled using floats made from various materials, including polyethylene. These floating docks, which rest in the water, can sustain damage during freezing of the water in which the floating dock rests or breakage of the ice formed in the spring during thawing. In order to protect floating docks from such spring damage, the floating docks can be secured in a sheltered cove or can be moored up against a marina. Better protection is afforded to the floating docks by removing them entirely from the water and storing them upon land during the winter months. Removal of the floating docks from the water is generally performed in one of various manners. One approach is to disconnect the linkages between portions, if any, and then lift the segments onto land. The lifting is performed using a crane, either by towing the floating dock to a location where a crane is stationed, such as for lifting boats out of the water, or by deploying a crane on the shore adjacent the floating dock. This can be slow, expensive and time-consuming. Another approach is to drag the floating dock segments onto land. In some cases, logs are used as rollers under the floating dock segments to facilitate movement of the segments across land. As can be imagined, this approach is arduous and can damage the floating dock segments.

Still another approach is to slip dollies or other wheeled structures under the floating dock segments. This is cumbersome as it requires alignment of the wheeled structures with the floating dock segments and securement of the wheel structures thereto. When the floating dock is re-deployed the following season, the wheel structures are removed from the floating dock segments.

It is therefore an object of the invention to provide a novel method and system for providing ground mobility for a dock.

SUMMARY OF THE INVENTION

According to an aspect of the invention, there is provided a system for providing ground mobility for a dock, comprising:

at least one wheel assembly, comprising:

a base element configured to be secured to a bottom portion of a dock; and at least one wheel rotatably coupled to said base element, each said wheel assembly being configured such that when said base element is secured to said bottom portion of said dock, said dock is at least partially supported by and rolls along ground on said wheels, wherein said at least one wheel assembly is buoyant in water.

The at least one wheel assembly can be sufficiently buoyant to maintain the dock above water when said at least one wheel assembly is secured to said dock and said at least one wheel assembly and said dock are placed in water.

The orientation of the at least one wheel can be fixed or can pivot relative to the base element.

The base element can include at least one hole for receiving a fastener to fasten the base element to the bottom portion of the dock. The at least one hole can be in a flange of the base element.

According to another aspect of the invention, there is provided a method for providing ground mobility for a dock, comprising:

securing at least one wheel assembly to a dock, each said at least one wheel assembly comprising a base element configured to be secured to a bottom portion of a dock and at least one wheel rotatably coupled to said base element, each said wheel assembly being buoyant in water and configured such that when said base element is secured to said bottom portion of said dock, said dock is at least partially supported by and rolls along ground on said wheels.

The at least one wheel assembly can be sufficiently buoyant to maintain the dock above water when the at least one wheel assembly is secured to the dock and the at least one wheel assembly and the dock are placed in water.

The orientation of the at least one wheel can be fixed or can pivot relative to the base element.

The securing can include fastening the wheel assembly to the bottom portion of the dock via at least one fastener, each fastener passing through a hole in the base element. The at least one hole can be in a flange of the base element.

According to a further aspect of the invention, there is provided a floating dock assembly, comprising:

a dock; and at least one wheel assembly, comprising:

a base element configured to be secured to a bottom portion of said dock; and at least one wheel rotatably coupled to said base element, each said wheel assembly being configured such that when said base element is secured to said bottom portion of said dock, said floating dock assembly is at least partially supported by and rolls along ground on said wheels, wherein said at least one wheel assembly is buoyant in water.

The at least one wheel assembly can be sufficiently buoyant to maintain the dock above water when the floating dock assembly is placed in water.

The orientation of the at least one wheel can be fixed or can pivot relative to the base element.

The base element can include at least one hole for receiving a fastener to fasten the base element to the bottom portion of the dock. The at least one hole can be in a flange of the base element.

BRIEF DESCRIPTION OF THE DRAWINGS

An embodiment will now be described, by way of example only, with reference to the attached Figures, wherein.

DETAILED DESCRIPTION OF THE EMBODIMENTS

The invention includes a method and system for providing ground mobility for a dock. By providing wheel assemblies that can be secured to the bottom portion of a dock, the dock can be rolled onto shore directly from the water. Further, by making the wheel assemblies buoyant in water, dock construction can be simplified, as the dock itself may not necessarily need to be buoyant in water itself.

Figure 1:
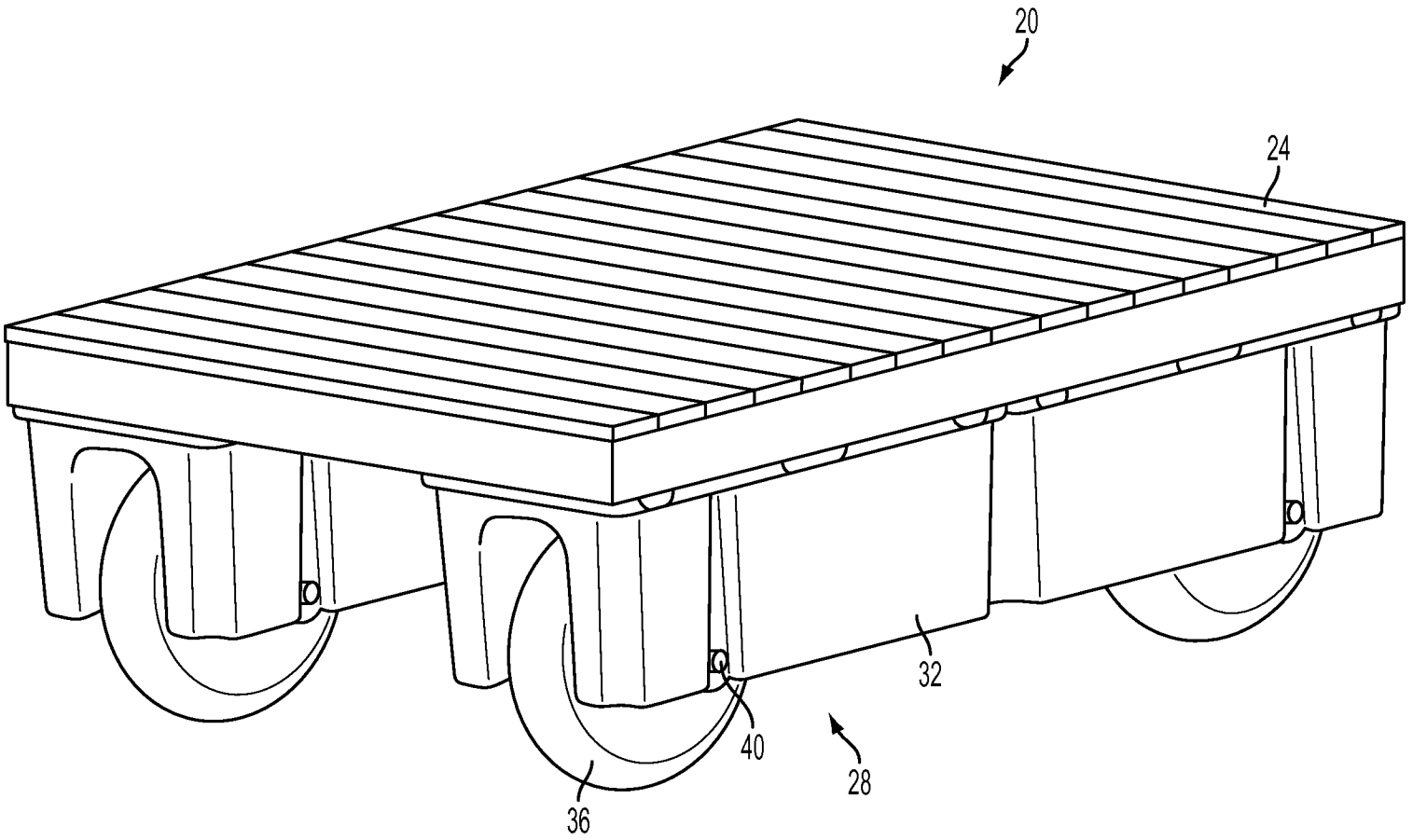
FIG. 1 shows a floating dock assembly in accordance with an embodiment of the invention.

A floating dock assembly 20 in accordance with an embodiment of the invention is shown in FIG. 1. The floating dock assembly 20 includes a dock 24 with a set of wheel assemblies 28. The dock 24 is constructed of a treated lumber that is resistant to rot. Alternatively, the dock 24 can be constructed of other materials, such as plastic, aluminum, cedar, recycled lumber, etc. Generally, the dock 24 is constructed with a rectangular frame having a set of slats across the top of the rectangular frame.

As shown, four wheel assemblies 28 are secured to the bottom portion of the dock 24. Each wheel assembly 28 includes a base element 32 that has a wheel 36 rotatably coupled to it via an axle 40 in a rigid (fixed) orientation relative to the base element 32. The base element 32 and the wheels 36 are polyethylene structures that are foam-filled to provide strength without making the base element 32 and wheels 36 heavy. Polyethylene is environmentally friendly, gasoline resistant, and resistant to aquatic wildlife, such as muskrats, otters and beavers. The wheels 36 are robust enough to withstand the weight of the floating dock assembly 20 when it is being rolled up on shore. The volume and mass of the base element 32 are such that the wheel assembly 28 is buoyant in water. Preferably, the base element 32 and/or the wheels 36 are sufficiently buoyant such that the dock 24 is maintained above the water level when the floating dock assembly is placed in water.

Figure 2:
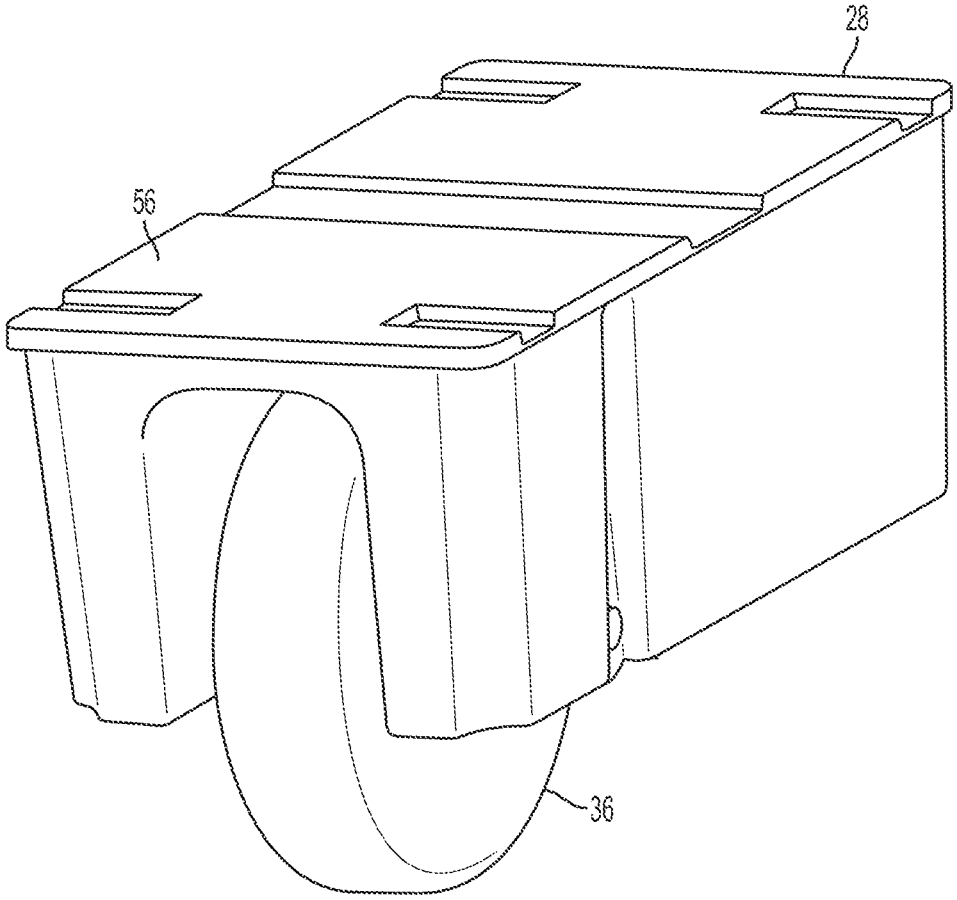
FIG. 2 shows a front perspective view of a wheel assembly used in the floating dock assembly of FIG. 1.
Figure 3:
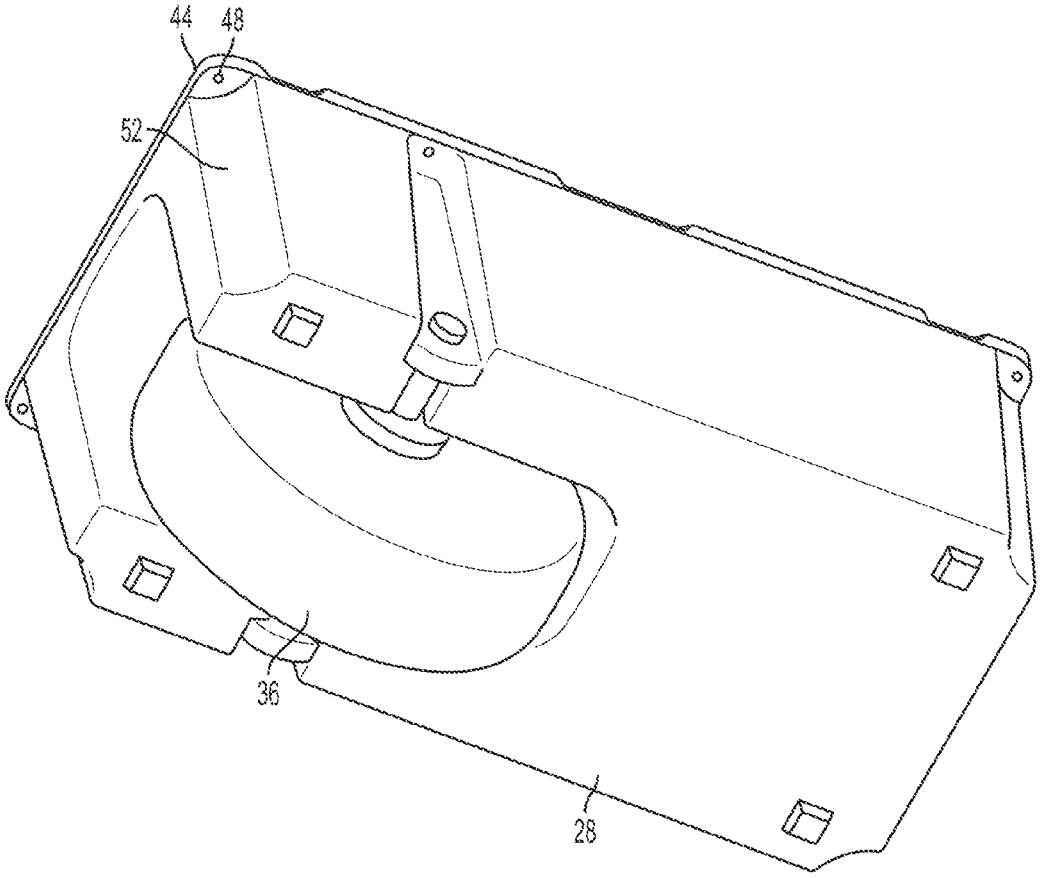
FIG. 3 shows a bottom perspective view of the wheel assembly of FIG. 2.
Figure 4:
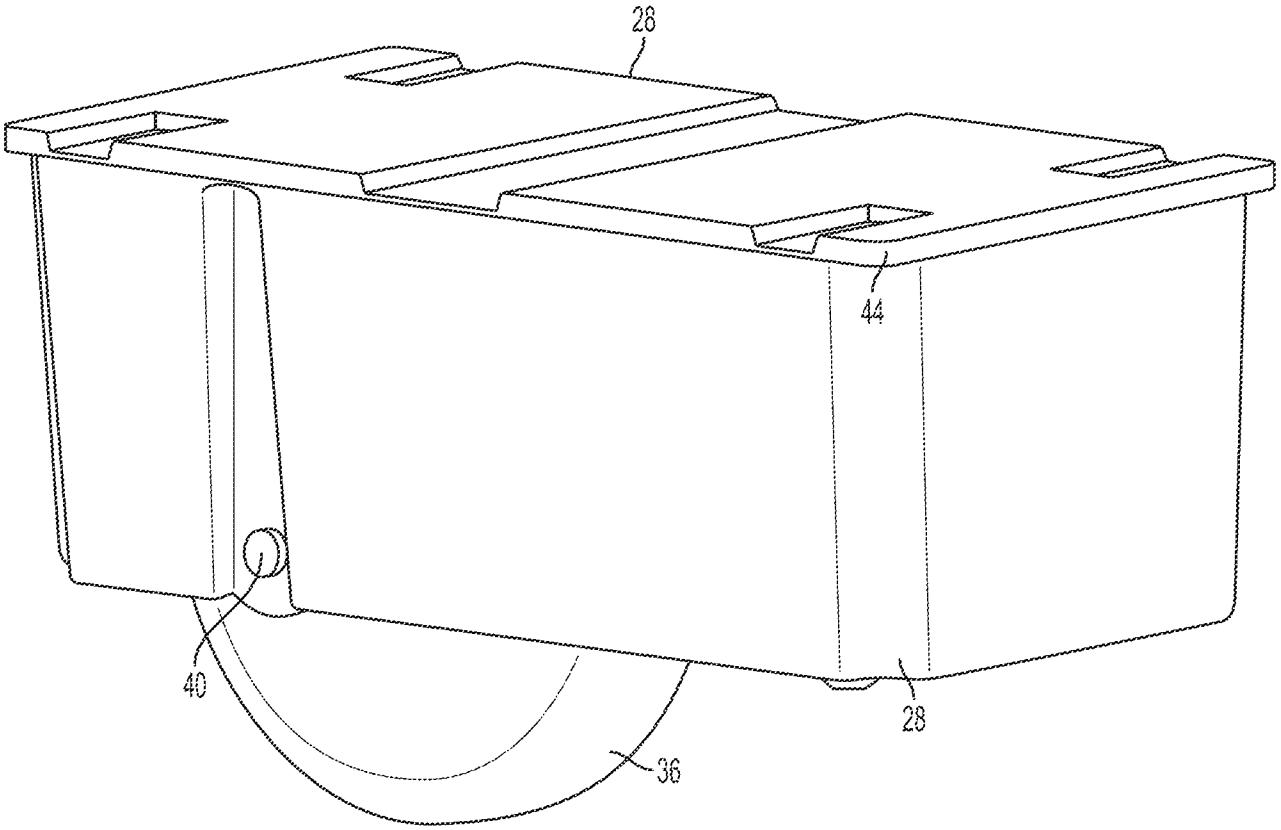
FIG. 4 shows a side perspective view of the wheel assembly of FIG. 2.

FIGS. 2 to 4 show the wheel assembly 28 in isolation from the dock 24 (i.e., prior to being secured to the dock 24). The base element 32 is shown having horizontal flanges 44 at the upper corners thereof. A hole 48 in each flange 44 is designed to receive a fastener, such as a screw, to secure the wheel assembly 28 to the dock 24. A recess 52 in each peripheral vertical edge of the base element 32 aligns with the flange 44 and provides access to the hole 48 to enable a fastener to be deployed therethrough. When two or more wheel assemblies 28 are aligned adjacent to one another on the dock, the recesses 52 align to maintain sufficient access to the holes 48 to enable securing of the wheel assemblies 28 close together.

A top surface 56 of the base element 32 is generally planar to correspond with a bottom portion of the dock to which the wheel assemblies 28 are secured. It will be understood that the wheel assemblies 28 can be designed to fit with docks having different features.

Figure 5:
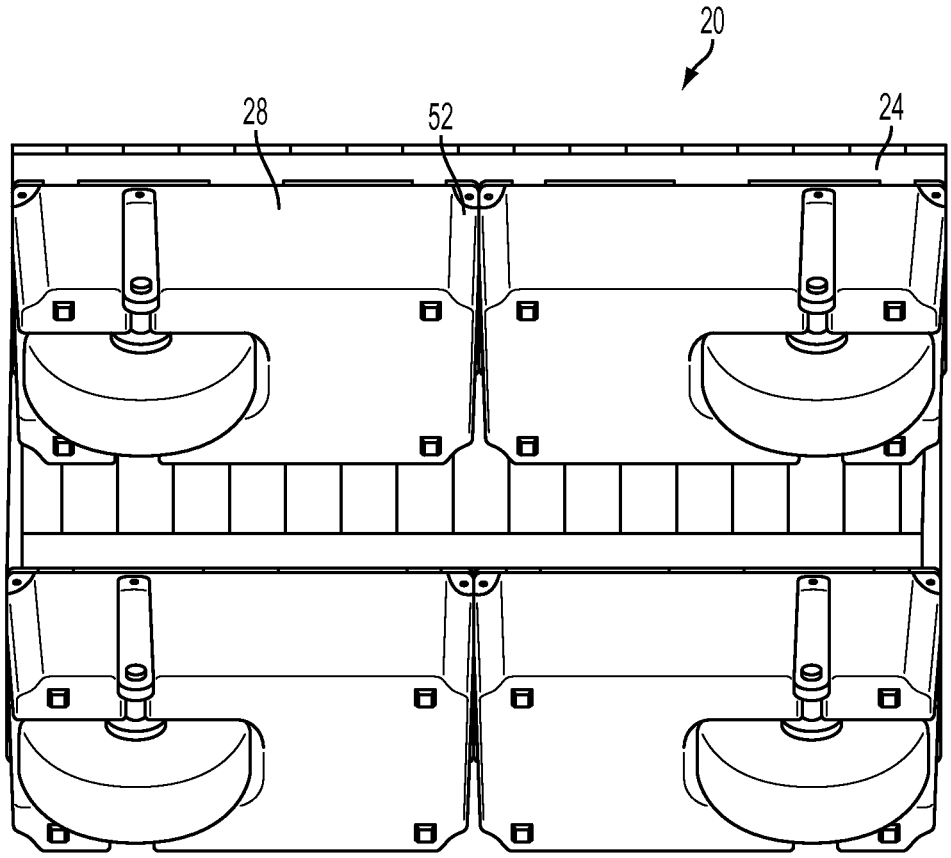
FIG. 5 is a bottom perspective view of the floating dock assembly of FIG. 1.

FIG. 5 shows a bottom perspective view of the floating dock assembly 20 of FIG. 1 showing the placement of the four wheel assemblies 28 on the bottom portion of the dock 24. As can be seen, the recesses 52 provide access to the holes 48 to enable the wheel assemblies 28 to be secured to the bottom portion of the dock 24 via screws. The screws are driven through the holes 48 into the bottom surface of the slats of the dock 24. In many scenarios, the wheel assemblies 28 are preferably positioned along or adjacent to a periphery of the dock 24 to provide better stability both when floating and on land.

The wheel assemblies 28 are provided in different depths and configurations to enable selection of an appropriate size and configuration for a dock 24. The wheel assemblies 28 can be selected such that the overall buoyancy of the floating dock assembly 20 maintains the dock 24 at a desired minimum height above water, thereby reducing exposure of the dock 24 and the hardware securing the wheel elements 28 to the dock 24 to the water. In this manner, the effects of wet rot can be reduced. Further, where the floating dock assembly 20 is being used for docking boats, it may be desirable to have the upper surface of the dock 24 at a higher level to enable easier embarkation and debarkation from the boats. It is also noted that too much overall buoyancy in some circumstances can maintain the dock 24 at higher than a desired level above the water.

By using lightweight wheel assemblies 28, less wood can be used to manufacture the dock 24. Further, the labor required to construct a floating dock assembly can be reduced. Variation of the height and shape of the base elements 32 and their construction enable the height of the dock 24 out of water to be varied.

In an alternative embodiment, the base elements 32 can include a pivoting portion onto which the wheels 36 are rotatably coupled. In this manner, the floating dock assembly 20 can be moved along ground in a direction other than the front-back orientation of the floating dock assembly 20.

While the invention has been described with specificity to wooden docks, other types of docks will occur to those of skill in the art.

Although the described dock is rectangular, the invention can be used with other shapes of docks. For example, the invention can be used with circular docks, polygonal docks, L and C-shaped docks, etc. As the wheel assemblies are made more modular, a larger variety of dock shapes can be accommodated.

Each base element 28 can alternatively include more than one wheel 36. The base elements 28 can be made from a variety of different materials, such as a molded plastic, a sealed foam, etc. They can be made in various shapes and sizes. Other compositions and configurations for the base elements 28 will occur to those skilled in the art.

The wheels can be made from a variety of different materials, such as rubber, a molded plastic, such as polyvinyl chloride, etc. At least some of the buoyancy of the wheel assemblies 28 can be derived from the wheels themselves. Other wheel compositions and configurations will occur to those skilled in the art.

The wheel assemblies 28 can be secured to the dock 24 via other means apart from fasteners. For example, the dock 24 may include features along its bottom portion to enable engagement of corresponding features of the wheel assemblies 28 therewith.

The wheel assemblies 28 may be at least partially secured to the dock 24 via other means, such as by features that engage corresponding features of the dock 24.

The wheel assemblies 28 can be provided with features, such as loops, to enable linkage elements, such as nylon cables, to connect the wheel assemblies 28 together. In this manner, multiple floating dock assemblies 20 can be moved as a unit and held together when deployed.

The above-described embodiments are intended to be examples of the present invention and alterations and modifications may be effected thereto, by those of skill in the art, without departing from the scope of the invention that is defined solely by the claims appended hereto.

What is claimed is:

1. A dock, comprising:

a bottom portion;

at least one wheel assembly having:

a hexahedron base element having flat sides and secured to said bottom portion of the dock wherein the flat sides form a buoyancy chamber; and at least one wheel rotatably coupled to and partially enclosed on three sides by said base element, wherein said base element is secured to said bottom portion when the dock is in use on water and on land, wherein said at least one wheel assembly is secured below and adjacent to a peripheral edge of the dock;

and wherein said at least one wheel assembly is buoyant in water.

2. The dock of claim 1, wherein said at least one wheel assembly is sufficiently buoyant to maintain said dock above water when said at least one wheel assembly is secured to said dock and said at least one wheel assembly and said dock are placed in water.

3. A method for providing ground mobility for a dock, comprising:

securing at least one wheel assembly to a dock, each said at least one wheel assembly comprising a hexahedron base element having flat sides wherein the flat sides form a buoyancy chamber; and secured to a bottom portion of a dock and at least one wheel rotatably coupled to and partially enclosed on three sides by said base element, each said wheel assembly being buoyant in water and secured to said bottom portion when the dock is in use on water and on land, such that said at least one wheel assembly is secured below and adjacent to a peripheral edge of the dock.

4. The method of claim 3, wherein said at least one wheel assembly is sufficiently buoyant to maintain said dock above water when said at least one wheel assembly is secured to said dock and said at least one wheel assembly and said dock are placed in water.

* * * * *